US006816124B2

(12) United States Patent
Tillery

(10) Patent No.: US 6,816,124 B2
(45) Date of Patent: Nov. 9, 2004

(54) LINEARLY-POLARIZED DUAL-BAND BASE-STATION ANTENNA

(75) Inventor: James K. Tillery, Woodstock, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 10/289,888

(22) Filed: Nov. 6, 2002

(65) Prior Publication Data

US 2004/0085250 A1 May 6, 2004

Related U.S. Application Data

(60) Provisional application No. 60/348,193, filed on Nov. 7, 2001.

(51) Int. Cl.[7] ..... H01Q 21/26
(52) U.S. Cl. ..... 343/797; 343/795; 343/813
(58) Field of Search ..... 343/795, 797, 343/813, 700 MS, 810, 811, 812, 844, 846, 702

(56) References Cited

U.S. PATENT DOCUMENTS 6,211,841 B1 * 4/2001 Smith et al. ..... 343/813
6,426,730 B1 * 7/2002 Nishizawa et al. ..... 343/795
6,646,611 B2 * 11/2003 Plet et al. ..... 343/797

* cited by examiner

*Primary Examiner*—Hoang V. Nguyen
(74) *Attorney, Agent, or Firm*—Charles A. Rather

(57) ABSTRACT

A dual-band antenna suitable for use in a cellular telephone network base station includes two parallel arrays of low-frequency dipole elements disposed on a ground plane, a raised array of high-frequency dipole elements disposed between the two parallel arrays, and at least one beamforming rod disposed between the raised array and the two parallel arrays. The two parallel arrays operatively form symmetric azimuth radiation patterns in a lower range of frequencies. The raised array and the high frequency beamforming rod likewise operatively form symmetric azimuth radiation patterns in a higher range of frequencies. This configuration of dual-band antenna allows reception and transmission of electromagnetic signals in two discrete frequency bands while occupying a compact space.

29 Claims, 6 Drawing Sheets

LINEARLY-POLARIZED DUAL-BAND BASE-STATION ANTENNA

CROSS-REFERENCE TO RELATED APPLICATIONS

This application claims priority under 35 U.S.C. §119(e) (1) to U.S. Provisional Patent Application Ser. No. 60/348,193 entitled LINEARLY-POLARIZED DUAL-BAND BASE-STATION ANTENNA, filed in the name of James K. Tillery on Nov. 7, 2001, the entirety of which is hereby incorporated by reference.

FIELD OF THE INVENTION

The present invention relates generally to communications using radio wave antennas, and relates more particularly to antennas for transmitting and receiving at a higher range of frequencies and a discrete lower range of frequencies.

BACKGROUND OF THE INVENTION

A dual-band antenna, as its name implies, covers two separate or discrete frequency bands, thus allowing it to replace two single-band antennas. Due in large part to stricter zoning requirements, there is a growing need for dual-band base-station antennas. The advantages of reducing the number of antennas needed at a base-station site include reduced "visual pollution", weight, wind-loading, and installation costs, as well as easier zoning approval. In addition, even if a carrier currently only uses one band, it can install a dual-band antenna now and reserve the unused band for future use. This reduces the expense of installing new antennas in the future and the trouble of having the site re-approved by a zoning board.

SUMMARY OF THE INVENTION

The present application is directed to particular features of a dual-band antenna. One aspect of the invention includes a ground plane, at least one array of individual low-frequency antenna elements disposed linearly along the ground plane and at least one array of individual high-frequency antenna elements.

In certain embodiments of the present invention, the array of high-frequency elements is elevated above the at least one of the low-frequency elements. The array of high-frequency elements may be asymmetric about its center.

In further embodiments, the arrays of low-frequency elements may be symmetrical about their centers, and individual low-frequency elements in separate arrays may be vertically aligned.

In still further embodiments, a high-frequency beamforming rod is disposed between the array of low-frequency elements and the array of high-frequency elements.

The low-frequency elements may include a gusset for securing one of the individual low-frequency elements to the ground plane. The gusset may further include a notch or the like for supporting at least a portion of the high-frequency beamforming rod.

The array of high-frequency elements and the beamforming rod cooperatively form a symmetrical azimuth radiation pattern in a high-frequency band, and the at least one array of low-frequency elements form a symmetrical azimuth radiation pattern in a lower-frequency band.

BRIEF DESCRIPTION OF THE DRAWINGS

Further aspects of the instant invention will be more readily appreciated upon review of the detailed description of the preferred embodiments included below when taken in conjunction with the accompanying drawings, of which.

DETAILED DESCRIPTION OF THE INVENTION

Referring now to FIGS. 1–10, wherein similar components of the present invention are referenced in like manner, various embodiments of a dual-band, base-station antenna are disclosed.

The main challenge in developing a dual-band base-station antenna is minimizing interference between the low-frequency and high-frequency bands while maintaining an acceptably small size. To accomplish this, a dual-band antenna may be created using a separate antenna element for each frequency band, or a single broadband antenna element that covers one or both bands. Certain embodiments of the dual-band antenna described herein employ separate elements for each band.

Figure 1:
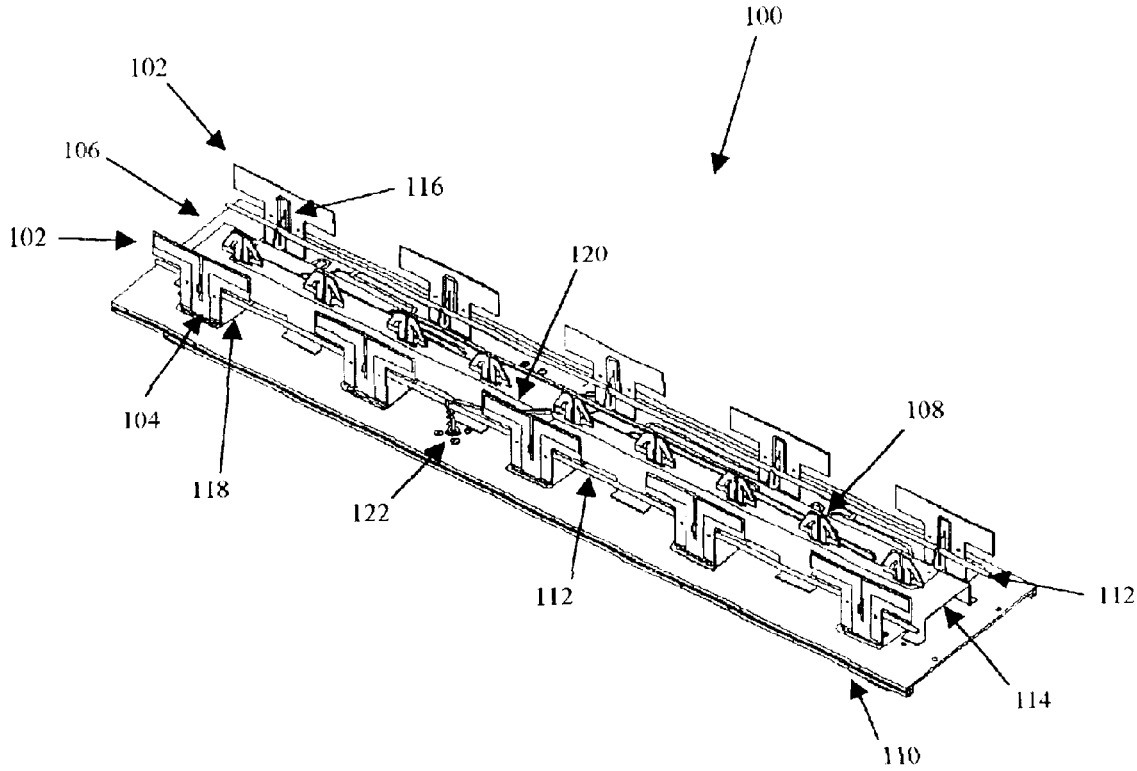
FIG. 1 is a top perspective view of a dual-band antenna according to certain embodiments of the present invention.

Turning now to FIG. 1, there is depicted a particular embodiment of a linearly-polarized dual-band antenna 100 for the transmission and reception of electromagnetic signals communicated over free space between a telecommunications network or the like and a plurality of wireless communication terminals, such as cellular telephones. One of ordinary skill in the art could adapt the configuration shown in FIG. 1 to cover various frequency bands, polarizations, beamwidths, and other desired antenna characteristics than those described particularly herein. For example, horizontal, circular, and dual-polarization are all possible using similar configurations.

The linearly-polarized dual-band antenna 100 includes a ground plane 110 having a low-frequency feed board 118 disposed thereon. At least one low-frequency array 102 includes a plurality of individual low-frequency elements 104, and is disposed linearly along the low-frequency feed board 118 near opposing edges of the ground plane 110. Each low-frequency element 102 is securely mounted to the low-frequency feed board 118 by one or more gussets 116. The gussets 116 used in each array 102 also support a portion of a high-frequency beamforming rod 112. A raised tray 114 is mounted along the center of the ground plane 110, and a high-frequency feed board 120 is disposed thereon. A high-frequency array 106, including a plurality of individual high-frequency elements 108, is disposed along the high-frequency feed board 120. A cable feed 122 is disposed between the ground plane 110 and the high-frequency feed board 120 to allow communication of electromagnetic signals between the high-frequency array 106 and a telecommunications network (not shown) through a port in the ground plane 110. A similar cable feed (not shown) may be used for the low-frequency feed board 118.

Metal-to-metal contact is minimized throughout the design to reduce potential for passive inter-modulation problems. The feed boards 118, 120 are electrically isolated from the ground plane 110 and raised tray 114, respectively. The raised tray 114 is also electrically isolated from the ground plane 110. The ground plane 110 and the raised tray 114 may be comprised of various conducting metals, and preferably are aluminum.

Figure 2:
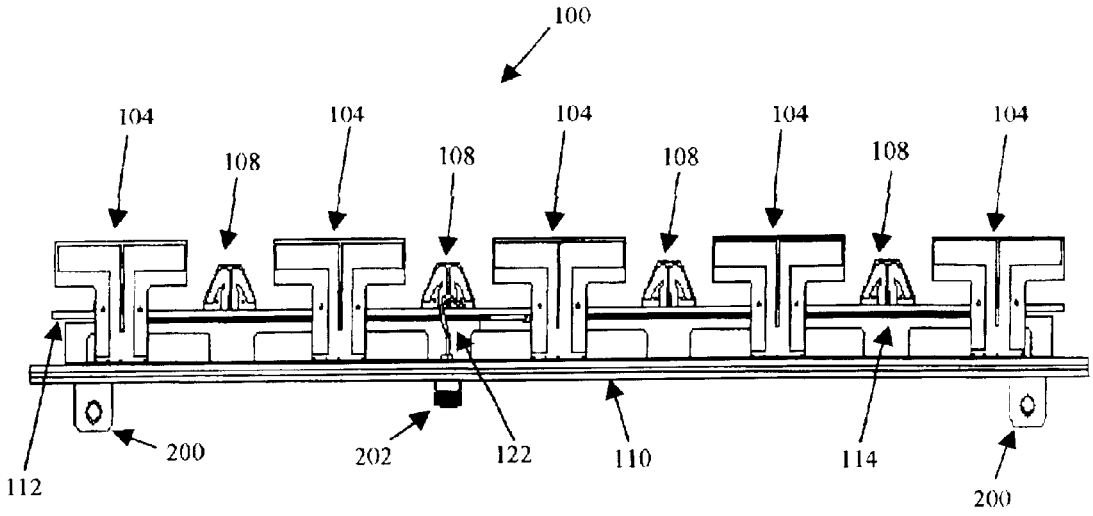
FIG. 2 is a side view of the dual-band antenna of FIG. 1.

The two outer arrays 102 of low-frequency elements 104 are mounted on the ground plane 110 to cover the low-frequency band. Two arrays 102 are used in the configuration shown in FIG. 1 for the low-frequency band, in order to achieve satisfactory beam-shaping in the azimuth plane. The low-frequency elements 104 may be manufactured from any useful, preferably low-cost, microwave substrate. The low-frequency elements 104 may be patch elements or equivalents. The low-frequency elements 104 may further be substantially flat and T-shaped dipole elements, as shown. Opposing pairs of low-frequency elements 104 may be centered or vertically-aligned when viewing the configuration from the side of the antenna 100, as shown in FIG. 2. Each array 102 may be symmetric or asymmetric about its center.

The single high-frequency array 106 on the raised tray 114 covers the high-frequency band. The high-frequency array 106, in conjunction with the beamforming rods 112, are used for the high-frequency band in the configuration shown, in order to achieve satisfactory beam-shaping in the azimuth plane. The high-frequency elements 108 may be manufactured from any useful, preferably low-cost, microwave substrate. The high-frequency elements 108 may be, for example, patch elements or dipole elements. Certain of the individual high-frequency elements 108 of the high-frequency array 106 may be vertically-aligned (i.e., aligned along an axis parallel to the shorter dimension of the ground plane 110 shown) with opposing pairs of low-frequency dipole elements 104 when viewed from the side of the antenna 100.

The beamforming rod 112, in certain embodiments, is a solid cylindrical aluminum rod, however, any of a variety of suitable configurations may be used. The beamforming rod 112 can be virtually any shape (round, square, flat, octagonal, etc.) and can be hollow or solid. The beamforming rod 112 may also be a plastic tube or rod with a thin metallic plating.

The position of the high-frequency elements 108 is critical in achieving good electrical performance in both bands. Improper placement of the high-frequency elements 108 can lead to difficult or insurmountable isolation and impedance matching issues in both the higher and lower bands. Not only is the height of these high-frequency elements 108 above the ground plane 110 important, but also their placement along the length of the ground plane 10 in relation to the low-frequency elements 104. In the configuration shown, their approximate positions were calculated and their final positions were determined empirically.

One alternate configuration, which was explored early in development, is to place the high-frequency elements 108 directly on the ground plane 110, thus eliminating the need for the raised tray 114 and the cable feed 122. The difficulty in this approach is that it greatly limits the ability to physically shift individual high-frequency elements 108 during assembly, making it much harder to overcome isolation and impedance matching issues. In addition, the high-frequency feed board 120 would have to be made in a tooth-like fashion to fit around the low-frequency feed board 118, which could double the manufacturing cost of the high-frequency board 120. This is due to the fact that in a tooth-like configuration, only two or three boards would fit on a standard panel of substrate, while in the current rectangular configuration, five boards will fit on the same standard panel of substrate. Particular configurations of the low-frequency feed board 118 and the high-frequency feed board 120 are further discussed below with respect to FIG. 4.

In order to maintain symmetrical radiation patterns, each array 102 of low-frequency elements 104 may be disposed linearly and may the array 102 may further be centered along the horizontal direction (shorter dimension) of the ground plane 110. The linear arrangement of high-frequency elements 108 of the high-frequency array 106 may also be centered along the horizontal direction of the ground plane 110. The high-frequency array 106 may further be centered horizontally between the arrays 102 of low-frequency elements 104.

Figure 8:
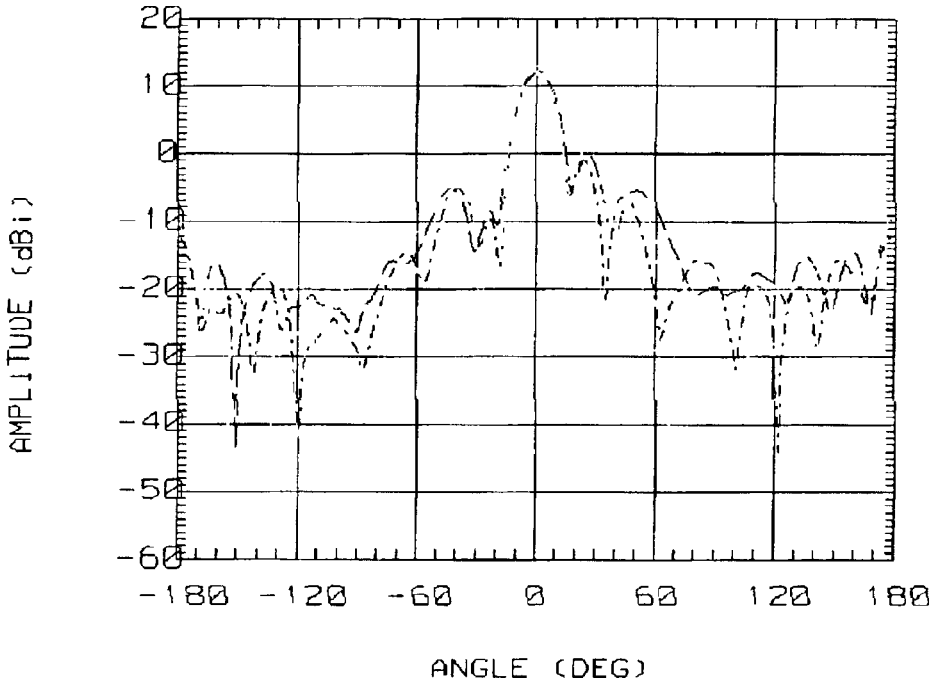
FIG. 8 is a graph depicting low-frequency elevation radiation patterns for the dual-band antenna of FIG. 1.
Figure 9:
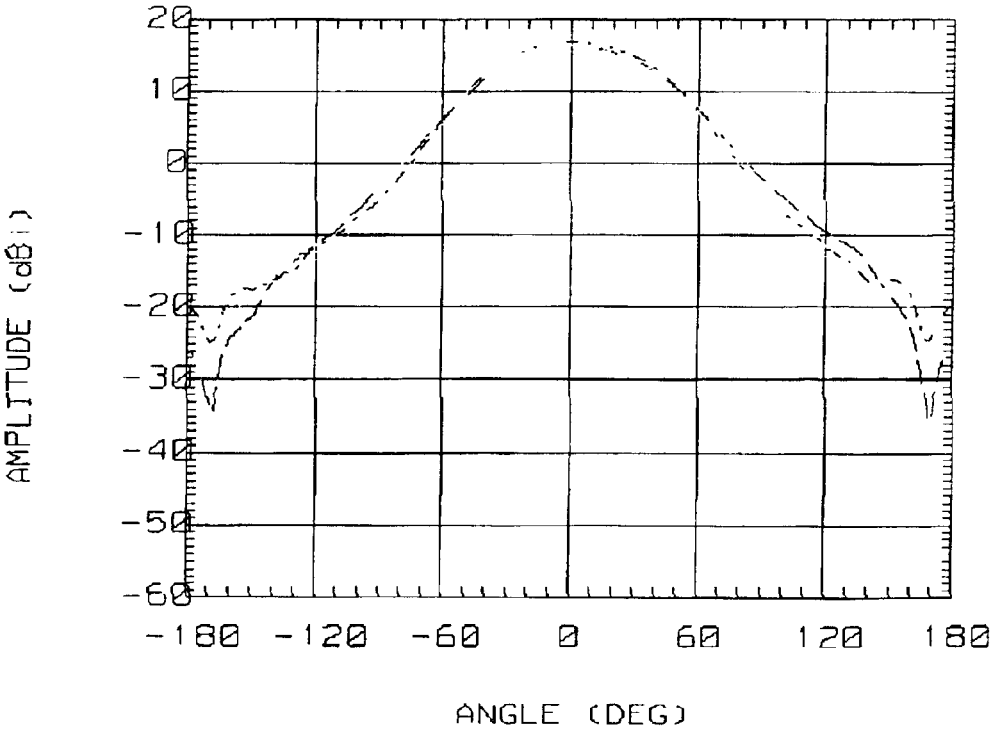
FIG. 9 is a graph depicting symmetrical high-frequency azimuth radiation patterns for the dual-band antenna of FIG. 1.
Figure 10:
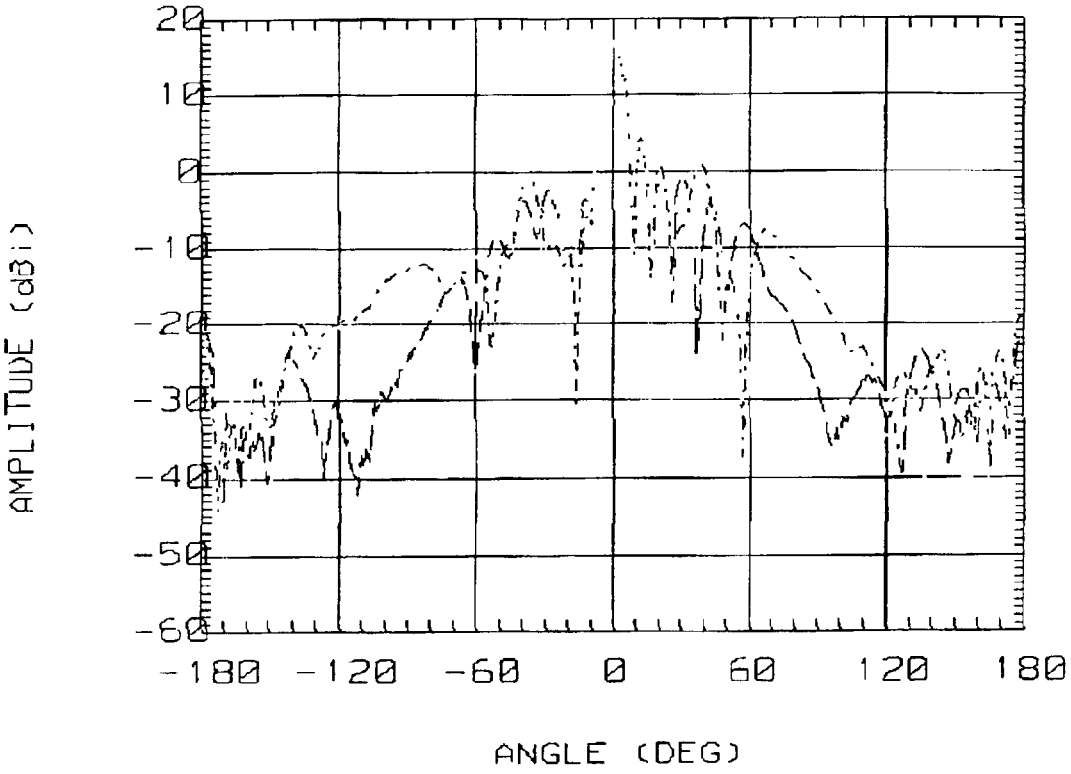
FIG. 10 is a graph depicting high-frequency elevation radiation patterns for the dual-band antenna of FIG. 1.

In the configuration shown, the linearly-polarized dual-band antenna 100 covers a lower range of frequencies (806–896 MHz) used in AMPS cellular telephone systems and a higher range of frequencies (1850–1990 MHz) used in PCS cellular telephone systems. The overall dimensions of the dual-band antenna 100, including a radome (not shown), are 48 inches (length) by 10 inches (width) by 5.79 inches (height). Both the high-frequency and low-frequency arrays have 65° azimuth beamwidth, 0° electrical downtilt, and are upper-sidelobe suppressed from 0° to approximately −20° as shown in FIGS. 8 and 10. Other beamwidths can be obtained by increasing or decreasing the spacing between the two outer arrays 102 of low-frequency elements 104 for the low-frequency band or by adjusting the beamforming rods for the high-frequency band.

Referring now to FIG. 2, a side view of the dual-band antenna 100 is shown. The side view demonstrates that opposing pairs of low-frequency elements 104 may be vertically aligned, and that certain of the high-frequency elements 108 may be vertically aligned with opposing pairs of aligned low-frequency elements 104. Brackets 200 are provided to facilitate mounting of the antenna 100. The antenna, in particular operating configurations, may be mounted with the vertical (longer dimension) perpendicular to the surface of the Earth and the horizontal (shorter) dimension parallel to the surface of the Earth. However, it should be readily understood that the antenna may be mounted in other orientations as desired. A network port 202 is provided for communication of electromagnetic signals between a telecommunications network and the antenna 100. The low-frequency feed board 118 and the high-frequency feed board 120 may be operatively connected to the network port 202 via appropriate coaxial cable feeds or a suitable equivalent.

Figure 3:
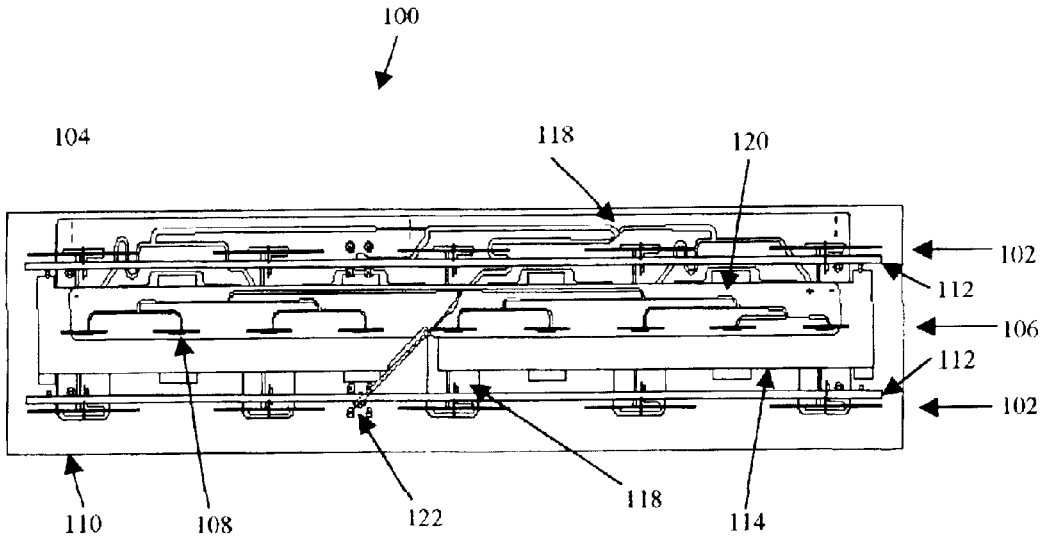
FIG. 3 is a front view of the dual-band antenna of FIG. 1.
Figure 4:
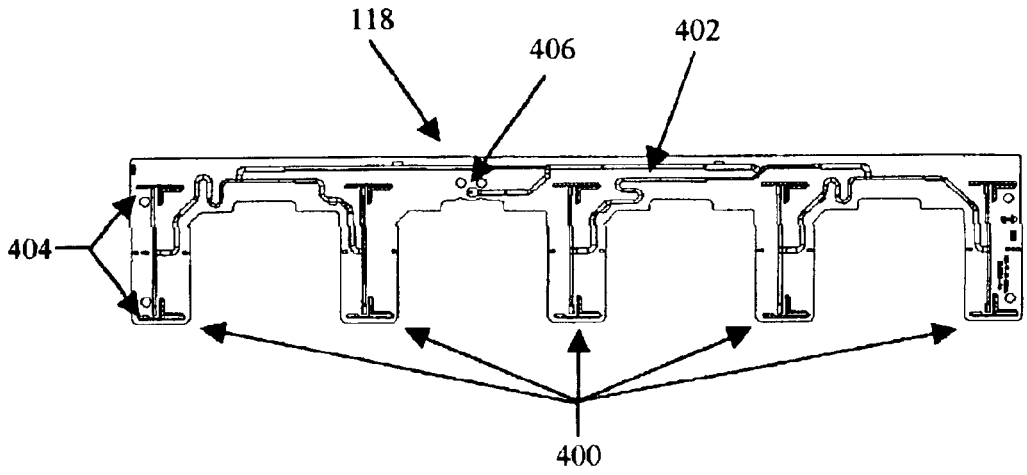
FIG. 4 is a top view of a low-frequency feed board according to certain embodiments of the present invention.

FIG. 3 is a front view of the dual-band antenna 100 shown in FIGS. 1 and 2. As shown, the ground plane 110 may be flat and rectangular and is longer in the vertical direction than in the horizontal direction Turning now to FIG. 4, therein is depicted a particular configuration of a low-frequency feed board 118. The low-frequency feed board 118 is designed in a tooth-like fashion so that it can be fabricated as a single piece, which results in easier assembly This is due to the fact that a multi-piece board would require additional solder joints to electrically connect the individual boards. The result would be more time and cost for manufacturing, and greater possibility of electrical failure due to improper soldering, misalignment of individual pieces, etc. The tooth-like boards 118 can be interleaved on a common substrate during the manufacturing process, thus reducing board waste and cost. The unique shape of the low-frequency feed board 118 and tooth-shaped sections also allows the raised tray 114 to be mounted directly to the ground plane 110 without interfering with the low-frequency feed board 118.

The low-frequency feed board 118 includes a plurality of etched microstrip circuits 402 or equivalents that connect mounting positions 404 for individual low-frequency elements 104 to a network port 406, in order to allow the communication of electromagnetic signals between a telecommunications network (not shown) and the dual-band antenna 100. In a particular configuration, the low-frequency feed board 118 may be a 62-mil thick, teflon-based, high quality microwave substrate or the like.

The high-frequency feed board 120 may be of similar design to the low-frequency feed board 118 The high-frequency feed board 120, however, is preferably rectangular to minimize manufacturing costs. In a particular configuration, the high-frequency feed board 120 may be comprised of a 31 mil thick, teflon-based, high-quality microwave substrate or the like.

Figure 5:
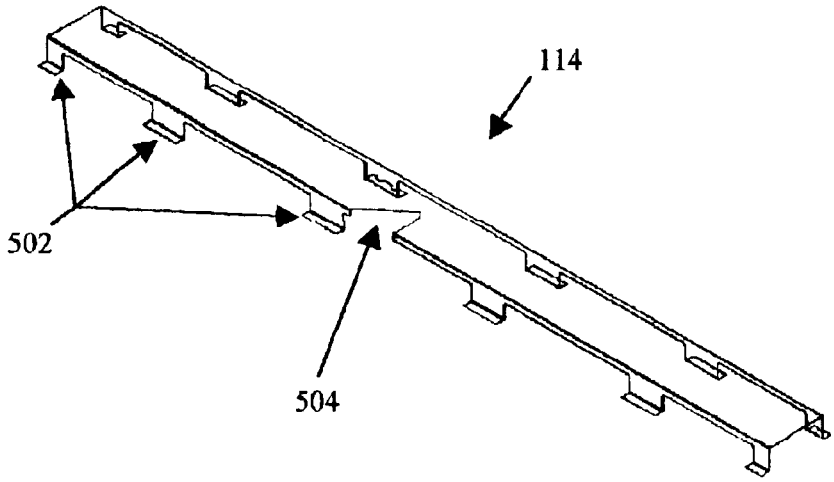
FIG. 5 is a top perspective view of a raised tray according to certain embodiments of the present invention.

FIG. 5 shows a particular configuration of the raised tray 114. The raised tray 114 may include a plurality of column supports 502 for mounting the raised tray 114 on the ground plane 110. The column supports 502 may be at least partially composed of a non-conducting material so as to electrically isolate the raised tray 114 from the ground plane 110. Alternatively, electrical isolation between the raised tray 114 and ground plane 110 may be achieved by placing a dielectric spacer (not shown), such as tape or foam, between them. The raised tray 114 may further include a notch 504 for accommodating and securing the cable feed 122. The raised tray 114 serves to elevate the bases of individual high-frequency elements 108 above the bases of the low-frequency elements 104.

Figure 6:
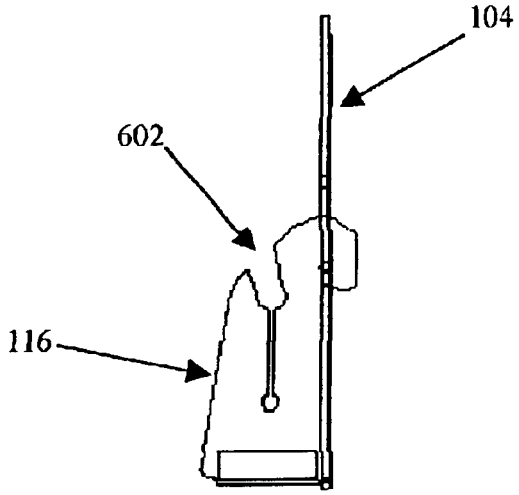
FIG. 6 is a side view of a low-frequency element and a gusset support according to certain embodiments of the present invention.
Figure 7:
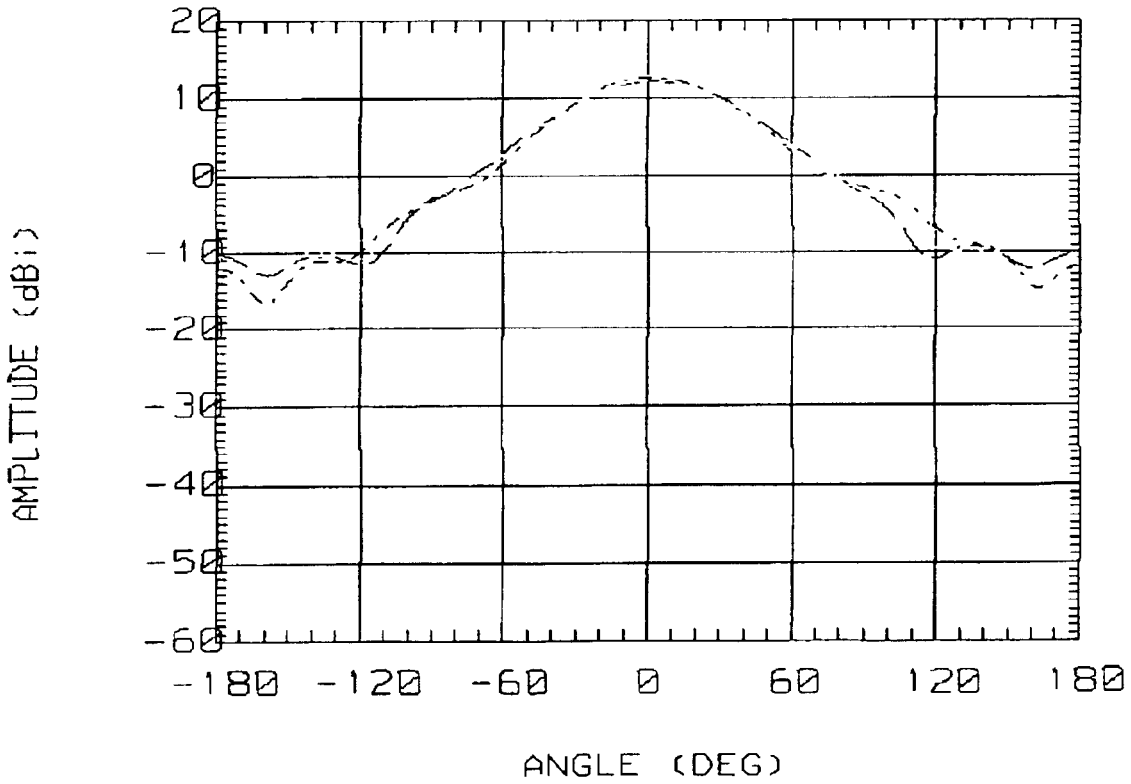
FIG. 7 is a graph depicting symmetrical low-frequency azimuth radiation patterns for the dual-band antenna of FIG. 1.

Turning now to FIG. 6, therein is depicted a side view of a low-frequency element 104. The low-frequency element 104 is supported on the low-frequency feed board 118 by a gusset 116. The gusset 116 may include a notch 602 for supporting at least a portion of the beamforming rods 112.

Measured data for the dual-band antenna 100 are shown in FIGS. 7–10. One advantage of the interleaved array approach to the dual-band antenna design described hereinabove is the substantially symmetrical azimuth radiation patterns it can produce in both the low- and high-frequency bands, as demonstrated in FIGS. 7 and 9, respectively. Elevation radiation patterns in the low- and high-frequency bands are shown in FIGS. 8 and 10, respectively.

All terms used herein to describe position or relationship to other elements should be understood to include a practical, mathematical margin of error. For example, the terms "parallel," "perpendicular," "linear," "rectangular," "symmetric," "centered," and "aligned" should be understood to mean "substantially parallel," "substantially perpendicular," "substantially linear," "substantially rectangular," "substantially symmetric," "substantially centered," and "substantially aligned," respectively.

Although the invention has been described in detail in the foregoing embodiments, it is to be understood that the descriptions have been provided for purposes of illustration only and that other variations both in form and detail can be made thereupon by those skilled in the art without departing from the spirit and scope of the invention, which is defined solely by the appended claims.

What is claimed is:

1. An apparatus for wireless transmission and reception of electromagnetic radiation in a high-frequency band and a discrete lower-frequency band, comprising a ground plane;

a first array of individual low-frequency elements disposed linearly along the ground plane;

a second array of individual low-frequency elements disposed linearly along the ground plane and parallel to the first array;

a third array of individual high-frequency elements disposed linearly between the first array and the second array; and a raised tray disposed on the around plane between the first array and the second array, wherein the third array of individual high-frequency elements is disposed on the raised tray.

2. The apparatus of claim 1, wherein a base of each high-frequency element is elevated above a base of at least one of the low-frequency elements.

3. The apparatus of claim 1, wherein the third array is disposed on the ground plane.

4. The apparatus of claim 1, wherein the third array is disposed parallel to the first array and the second array.

5. The apparatus of claim 1, further comprising:

a beamforming rod disposed between the first array and the third array.

6. The apparatus of claim 5, wherein the beamforming rod is disposed parallel to the first array and the third array.

7. The apparatus of claim 5, further comprising:

a gusset for securing one of the individual low-frequency elements to the ground plane, wherein the gusset Further supports at least a portion of the beamforming rod.

8. The apparatus of claim 7, said gusset including a notch for receiving the portion of the beamforming rod.

9. The apparatus of claim 5, further comprising:

a second beamforming rod disposed between the second array and the third array.

10. The apparatus of claim 5, wherein the beamforming rod comprises a solid cylindrical aluminum rod.

11. The apparatus of claim 5, wherein the third array of high-frequency elements and the beamforming rod form a symmetrical azimuth radiation pattern in a high-frequency band, and the first array and the second array of low-frequency elements form a symmetrical azimuth radiation pattern in a low-frequency band.

12. The apparatus of claim 1, said ground plane comprising two opposing longer parallel edges and two opposing shorter parallel edges.

13. The apparatus of claim 12, wherein the ground plane is flat and rectangular.

14. The apparatus of claim 12, wherein the first array is disposed linearly along a first of said two opposing longer parallel edges.

15. The apparatus of claim 14, wherein the second array is disposed linearly along a second of said two opposing longer parallel edges.

16. The apparatus of claim 12, further comprising:

at least one beamforming rod disposed between the first array and the third array, wherein the third array of high-frequency elements and the at least one high-frequency beam-forming rod form a symmetrical azimuth radiation pattern in a high-frequency band.

17. The apparatus of claim 12, wherein the first array of low-frequency elements and the second array of low-frequency elements form a symmetrical azimuth radiation pattern in a low-frequency band.

18. The apparatus of claim 1, wherein the ground plane comprises aluminum.

19. The apparatus of claim 1, further comprising:

a low-frequency feed board, disposed between the low-frequency elements and the ground plane, for transmitting and receiving electromagnetic signals between the low-frequency elements and a telecommunications network.

20. The apparatus of claim 19, wherein said low-frequency feed board comprises a microstrip substrate.

21. The apparatus of claim 19, wherein said low-frequency feed board comprises a plurality of tooth-shaped inter-connected elements, each electrically connecting an individual low-frequency element from the first array and an opposing individual low-frequency element from the second array.

22. The apparatus of claim 1, further comprising:

a high-frequency feed board, disposed between the high-frequency elements and the ground plane, for transmitting and receiving electromagnetic signals between the high-frequency elements and a telecommunications network.

23. The apparatus of claim 1, wherein the high-frequency feed board is rectangular.

24. The apparatus of claim 1, wherein each individual low-frequency element in the first array is vertically aligned with an individual low-frequency element in the second array.

25. The apparatus of claim 1, wherein the individual high-frequency elements are asymmetrically distributed about a center of the third array.

26. A dual-band antenna, comprising:

a ground plane;

a first array of low-frequency elements disposed linearly along an edge ground plane;

a raised tray disposed on the ground plane; and a second array of high-frequency elements disposed linearly along the raised tray and parallel to the first array.

27. The dual-band antenna of claim 26, further comprising: a third array of low-frequency elements disposed linearly along an opposing edge of the ground plane and parallel to the first array, wherein each low-frequency element of the first array is vertically-aligned with a low-frequency element of the third array.

28. The apparatus of claim 27, further comprising:

a low-frequency feed board disposed between the ground plane and having a plurality of tooth-shaped sections operatively securing an individual low-frequency element from the first array and a vertically-aligned individual low-frequency element from the third array;

a high-frequency feed board disposed between the individual high-frequency elements and the raised tray, each of the low-frequency board and the high-frequency board having a plurality of microstrips for transmitting electromagnetic signals between a telecommunications network and the respective high-frequency elements and low-frequency elements; and at least one of: a high-frequency beam-forming rod disposed between the first array and the second array, parallel to each of the first array and the second array, and a high-frequency beam-forming rod disposed between the second array and the third array, parallel to each of the second array and the third array.

29. A dual-band antenna apparatus, comprising:

at least one low-frequency element disposed on a ground plane;

at least one high-frequency element elevated above the ground plane; and a high frequency-beamforming rod disposed between the low-frequency element and the elevated high-frequency element along the ground plane, whereby the at least one low-frequency element forms a symmetrical azimuth radiation pattern, and the at least one high-frequency element and the high-frequency beam-forming rod form a symmetrical azimuth radiation pattern.

* * * * *